US011371337B2

(12) United States Patent
Boutin et al.

(10) Patent No.: US 11,371,337 B2
(45) Date of Patent: Jun. 28, 2022

(54) LINER TOP TEST TOOL

(71) Applicant: Wellbore Specialties, LLC, Lockport, LA (US)

(72) Inventors: Jacob Boutin, Lafayette, LA (US); Eric Marchand, Houma, LA (US); Wilbert Dean, Houma, LA (US); Joshua Cormier, Lockport, LA (US)

(73) Assignee: Wellbore Specialties, LLC, Lockport, LA (US)

( * ) Notice: Subject to any disclaimer, the term of this patent is extended or adjusted under 35 U.S.C. 154(b) by 0 days.

(21) Appl. No.: 16/614,781

(22) PCT Filed: May 21, 2018

(86) PCT No.: PCT/US2018/033743

§ 371 (c)(1),
(2) Date: Nov. 18, 2019

(87) PCT Pub. No.: WO2018/213845

PCT Pub. Date: Nov. 22, 2018

(65) Prior Publication Data

US 2020/0199997 A1 Jun. 25, 2020

Related U.S. Application Data

(60) Provisional application No. 62/508,868, filed on May 19, 2017.

(51) Int. Cl.

| | |
|---|---|
| ***E21B 33/12*** | (2006.01) |
| ***E21B 47/01*** | (2012.01) |
| *E21B 47/117* | (2012.01) |
| *E21B 33/128* | (2006.01) |
| *E21B 33/129* | (2006.01) |
| *E21B 43/10* | (2006.01) |

(52) U.S. Cl.

CPC ..... *E21B 47/01* (2013.01); *E21B 33/1208* (2013.01); *E21B 33/128* (2013.01); *E21B 33/129* (2013.01); *E21B 43/103* (2013.01); *E21B 47/117* (2020.05)

(58) Field of Classification Search

CPC ..... E21B 47/01; E21B 47/117; E21B 43/103; E21B 33/1208; E21B 33/12; E21B 33/128; E21B 33/129

USPC ..... 166/387

See application file for complete search history.

(56) References Cited

U.S. PATENT DOCUMENTS

| | | | | |
|---|---|---|---|---|
| 4,372,393 A * | 2/1983 | Baker | E21B 23/02 | 166/138 |
| 5,740,860 A * | 4/1998 | Crawford | E21B 17/028 | 166/64 |
| 8,807,227 B2 * | 8/2014 | Fould | E21B 23/004 | 166/373 |
| 9,022,121 B1 | 5/2015 | Penisson | | |

(Continued)

*Primary Examiner* — Taras P Bemko

(74) *Attorney, Agent, or Firm* — Ian C. Barras; Intellectual Property Consulting, LLC

(57) ABSTRACT

Disclosed is a liner top test tool with a scraper cartridge and seal back-up rings for testing casing integrity in a wellbore. The seal back-up rings are comprised of first and second ring elements that are biased apart by compression springs. The first ring element has a boss that inserts into a bore of the second ring element, blocking debris from flowing into the interior of the seal back-up ring.

21 Claims, 11 Drawing Sheets

(56) References Cited

U.S. PATENT DOCUMENTS

| | | | | |
|---|---|---|---|---|
| 2012/0055681 | A1* | 3/2012 | Telfer | E21B 34/10 166/373 |
| 2014/0090832 | A1* | 4/2014 | Tinnen | E21B 34/10 166/242.1 |
| 2016/0177646 | A1* | 6/2016 | Penisson | E21B 27/00 166/99 |

* cited by examiner

LINER TOP TEST TOOL

CROSS-REFERENCE TO RELATED APPLICATION

This application claims priority from U.S. Provisional Application No. 62/508,868, filed on May 19, 2017, which is incorporated herein by reference as if set forth in full below.

BACKGROUND

1. Field

The present invention relates to the field of oil and gas drilling and production. More particularly, the invention relates to an apparatus and method for sealing the annulus between the well casing and liner in a borehole of an oil and gas well.

2. Description of Related Art

This application incorporates by reference, as if set forth in full herein, the specification of U.S. Pat. No. 9,022,121 (Penisson), relating to an apparatus and method for sealing the annulus between the well casing and liner in a borehole of an oil and gas well, upon which the disclosed invention improves.

More specifically, the seal back-up rings of Penisson suffered from the problem that debris from the borehole or otherwise in the drilling fluid could flow into the interior of the seal back-up rings, that is, in around the plurality of compression springs of the seal back-up rings of Penisson. When debris flows in such a fashion, such debris could prevent the first ring and the second ring from moving into a closed position.

Additionally, the liner top test tool of Penisson does not include a tool for scraping or cleaning the casing or the lower liner or cleaning the area around where a seal test is to be performed.

BRIEF SUMMARY

The present invention provides a back-up ring for the seals of a liner top test tool that will satisfy the aforementioned needs. The seal back-up ring is comprised of first or upper rings and an interconnected longer second or lower ring and a means to move the first ring away from the second ring along the axis of the casing. The first ring has a plurality of radially extend ring flanges that intersect with a like number of fluid channels on the radial surface of the second ring. Moving the first ring away from the second ring along the axis of the casing serves to create an enhanced flow passage between the seal back-up ring and the casing along the fluid channels on the radial surface of the second ring. Once the liner top test tool with the associated back-up ring and seals is placed comes in contact with the top of the lower liner, the continued motion of the mandrel moves the first ring toward the second ring to close the fluid channels on the radial surface of the second ring. The seals can then be squeezed against casing in the conventional manner to form a pressure seal between the liner top test tool and the casing.

The two part seal back-up ring described herein can be sized to maximum drift diameter and separated for high flow rates. Because the flow passages of the seal back-up can be enhanced for ease of insertion of the liner top test tool by separation of the rings and then closed to effectuate the sealing during testing, use of the seal back-up ring described herein will allow for higher fluid flow rates and higher test pressures.

The mill-shoe assembly, comprising a scraper cartridge and a mill-shoe, is used for cleaning the casing and lower liner in a wellbore. The scraper cartridge is used for cleaning about the entire circumference of an upper section of casing without rotating the drill string, and the mill-shoe is used for cleaning a lower, smaller, section of casing.

In accordance with one embodiment, an object of the present invention is to provide a seal back-up ring for use in a liner top test tool for testing the seal provided between adjacent welllbore casing placed in a wellbore, the seal back-up ring comprising: a first ring, said first ring having a plurality of radially extending flanges and a tubular boss having a plurality of holes for allowing fluid flow; a second ring, said second ring having a plurality of channels on a peripheral surface of said second ring, each channel of said second ring corresponding with one of said radially extending flanges of said first ring, and a bore capable of slidably receiving said tubular boss; a compression spring configured to bias said first ring away from said second ring along a longitudinal axis of said wellbore; an alignment pin attached to said first ring; and an alignment guide in said second ring for receiving said alignment pin.

In accordance with one embodiment, an object of the present invention is to provide a liner top test tool for testing the integrity of casing in a wellbore comprising: a seal back-up ring, wherein said seal back-up ring comprises: a first ring, said first ring having a plurality of radially extending flanges, and a tubular boss having a plurality of holes for allowing fluid flow; a second ring, said second ring having a plurality of fluid flow channels radially spaced around a peripheral surface of said second ring, each fluid flow channel corresponding to one of said radially extending flanges of said first ring, and a bore capable of slidably receiving said tubular boss; an alignment pin attached to said first ring; an alignment guide in said second ring for receiving said alignment pin.

BRIEF DESCRIPTION OF THE DRAWINGS

For a further understanding of the nature, objects, and advantages of the present disclosure, reference should be had to the following detailed description, read in conjunction with the following drawings, wherein like reference numerals denote like elements.

Figure 1A:
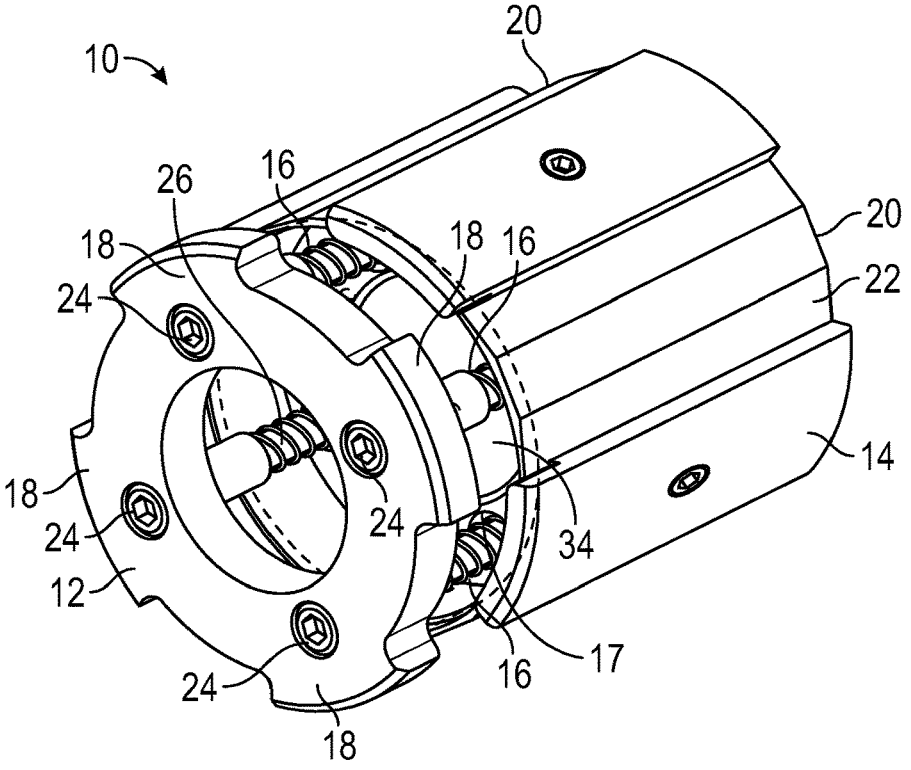
FIG. 1A is an isometric view of the seal back-up ring for the seals of a liner top test tool shown in open position, with the boss of the first ring shown in transparency.

In the drawings, certain features that are well established in the art and do not bear upon points of novelty may have been omitted in the interest of descriptive clarity. Such omitted features may include threaded junctures, weld lines, sealing elements, pins and brazed junctures.

DETAILED DESCRIPTION

Before the subject disclosure is further described, it is to be understood that the disclosure is not limited to the particular embodiments of the disclosure described below, as variations of the particular embodiments may be made and still fall within the scope of the appended claims. It is also to be understood that the terminology employed is for the purpose of describing particular embodiments, and is not intended to be limiting. Instead, the scope of the present disclosure will be established by the appended claims.

In this specification and the appended claims, the singular forms "a," "an," and "the" include plural reference unless the context clearly dictates otherwise. Unless defined otherwise, all technical and scientific terms used herein have the same meaning as commonly understood to one of ordinary skill in the art to which this disclosure belongs.

Figure 1B:
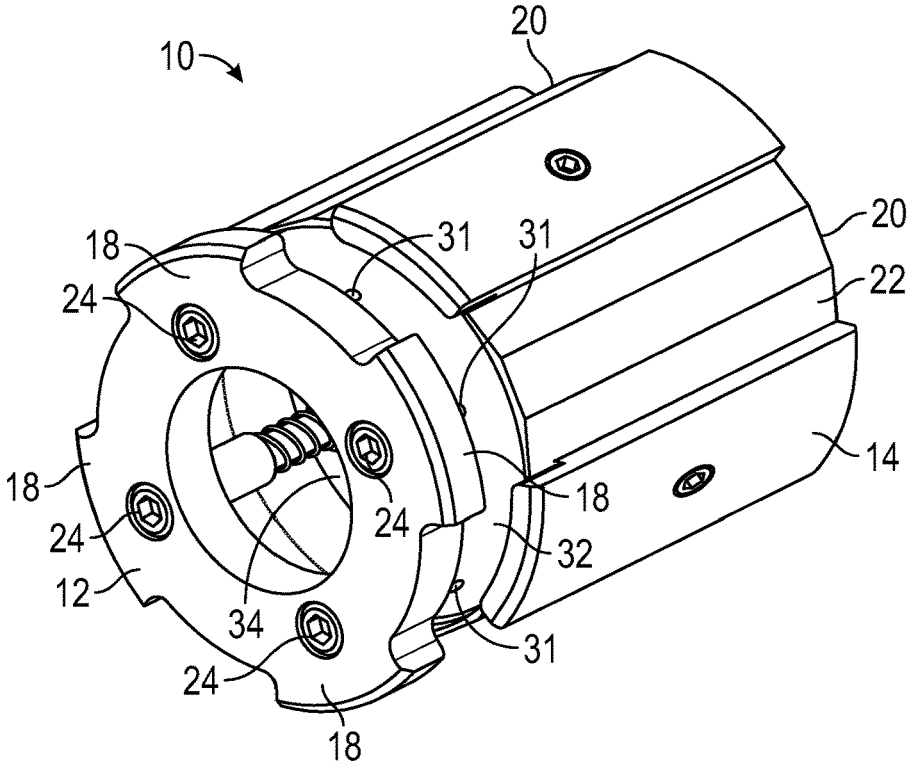
FIG. 1B is an isometric view of the seal back-up ring with the boss of the first ring shown as opaque.

Referring now to the drawings and more particularly, to FIGS. 1A and 1B, there is shown an isometric view of the seal back-up ring 10 for the seals of a liner top test tool. The seal back-up ring 10 is comprised of first ring 12 and an interconnected longer or thicker second ring 14. The first ring 12 is biased away from the second ring 14 along the central axis of first ring 12 and second ring 14 by a plurality of compression springs 16 fitted to and distributed about the periphery of the first and second rings in alignment guides 17.

The first ring 12 has a plurality of flanges 18 that are radially extending and that intersect with a like number of fluid flow passages or flow channels 20 that are distributed radially on the peripheral surface 22 of the second ring 14. The first ring 12 also has a boss 32 extending axially away from the top of first ring 12 towards second ring 14; and second ring 14 has a bore 34 for receiving boss 32. Boss 32 has a plurality of holes 31. Boss 32 blocks debris from flowing into the interior of seal back-up ring 10, but the plurality of holes 31 allow fluid, but not debris, to enter bore 34 of seal back-up ring 10 when seal back-up ring 10 is in an open position. When the compression springs 16 are extended, the springs move the first ring 12 away from the second ring 14 along the central axis of first ring 12 and second ring 14 to open the flow channels 20. When the compression springs 16 are compressed, the first ring 12 moves toward the second ring 14, and boss 32 moves into bore 34, along the central axis of first ring 12 and second ring 14, to close the flow channels 20.

The first ring 12 and an interconnected longer second ring 14 of the seal back-up ring 10 are held together longitudinally by means of a plurality of assembly bolts 24, each assembly bolt 24 having a narrower alignment pin 26. Compression springs 16 are fitted about alignment pins 26. The assembly bolts 24 are distributed around the first ring 12 and are connected to the first ring 12 by threaded holes in the first ring 12. The alignment pins 26 of assembly bolts 24, slide into alignment guides 17. The alignment guides 17 are bored into the second ring 14 along its longitudinal axis. When the compression springs 16 are compressed, the flanges 18 of the first ring 12 will move toward the peripheral surface 22 of the second ring 14 and the alignment pins 26 will slide into the alignment guides 17, as the seal back-up ring 10 is closed.

In FIG. 1A, boss 32 is depicted as transparent, for the purposes of describing the components of the seal back-up ring 10. FIG. 1*a* shows the seal back-up ring 10 in an open position with the first ring 12 extended away from the thicker second ring 14 by means of the extended compression springs 16. When the seal back-up ring is in the open position, the flow channels 20 create an enhanced fluid flow path around the peripheral surface 22 of the second ring 14.

FIG. 1B shows seal back-up ring 10 with boss 32 shown as opaque.

Figure 2A:
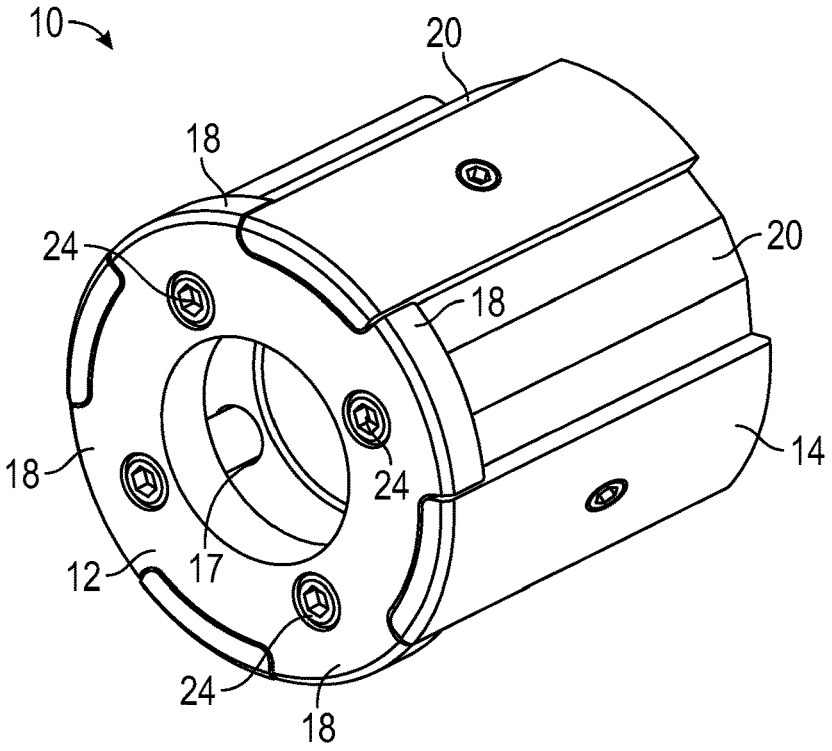
FIG. 2A is an isometric view of the seal back-up ring in a closed position.

FIG. 2A shows the seal back-up ring 10 of FIG. 1 in the closed position. When the seal back-up ring 10 is in a closed position, the compression springs 16 are compressed and the first ring 12 is fitted against the second ring 14. When so fitted, the flanges 18 of the first ring 12 cover the flow channels 20 of the second ring so that the flow channels 20 are closed or blocked to restrict fluid flow around the peripheral surface 22 of the second ring 14. When seal back-up ring 10 is in a closed position, first ring 12 and second ring 14 create a complete bearing area for applying pressure against seal element 142 (see FIGS. 12 and 13).

Figure 2B:
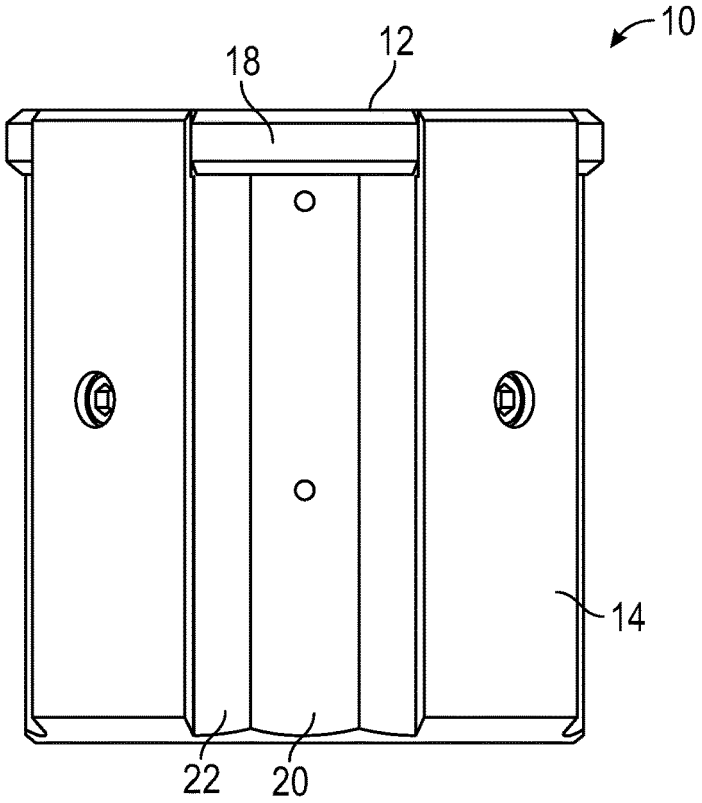
FIG. 2B is a side view of the seal back-up ring in a closed position.

FIG. 2B shows a side view of the seal back-up ring 10 of FIG. 1 in the closed position.

Figure 3A:
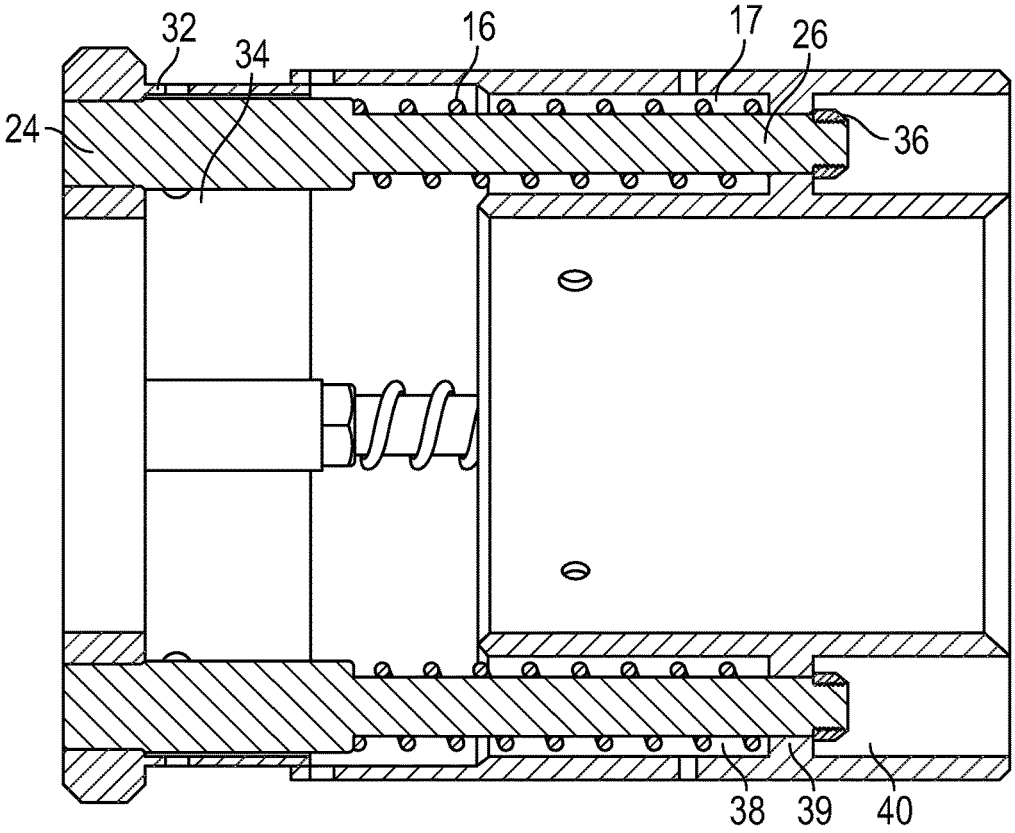
FIG. 3A is a side cross-section view of a seal back-up ring in an open position.
Figure 3B:
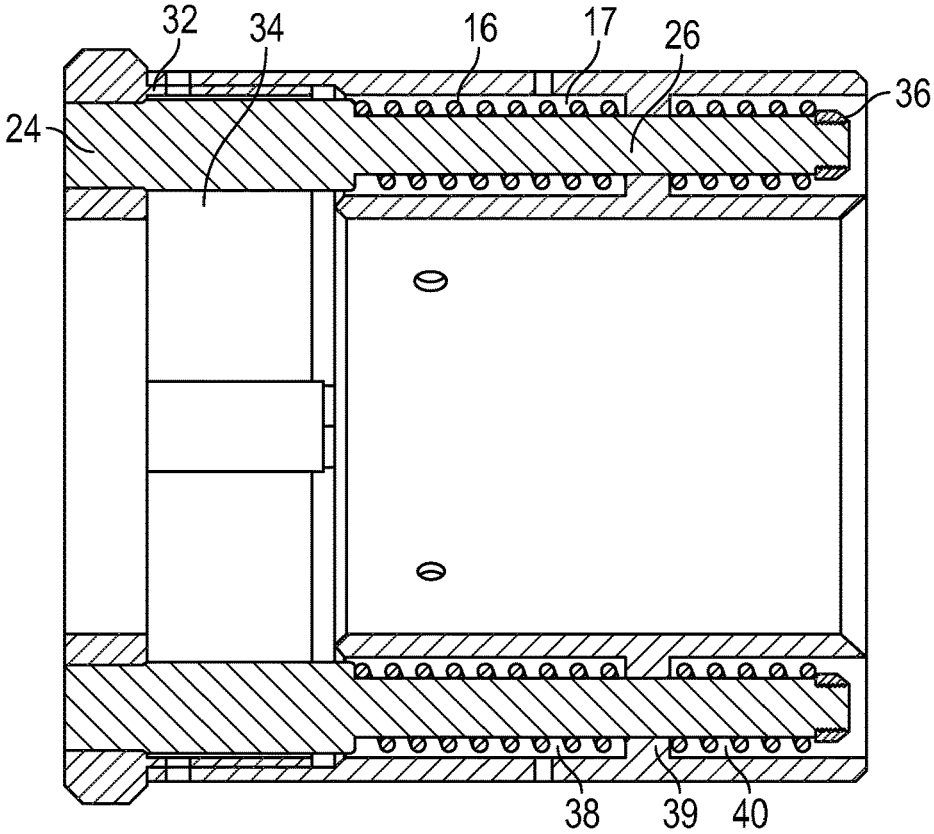
FIG. 3B is a side cross-section view of a seal back-up ring in a closed position.

FIG. 3A is a cross section view of the seal back-up ring 10 in an open position, and FIG. 3B is a cross section view of the seal back-up ring 10 in a closed position. FIGS. 3A and 3B depict alignment pins 26 of assembly bolts 24 sliding into alignment guides 17, and resulting compression of compression springs 16. Alignment guides 17 further comprise inner guide 38, restrictor plate 39, and outer guide 40. Restrictor plate 39 is a narrowing of alignment guide 17 that is larger than alignment pin 26 but smaller than restrictor nut 36. Restrictor nuts 36 are affixed to the end of assembly bolts 24 by means of threading on assembly bolts 24. Compression springs 16 press against restrictor plate 39. As seal back-up ring 10 moves to an open position, restrictor plate 39 causes restrictor nut 36 to remain in outer guide 40, thus causing alignment pin 26 to remain in outer guide 40, thus keeping boss 32 at least partially inside bore 34.

Figure 4:
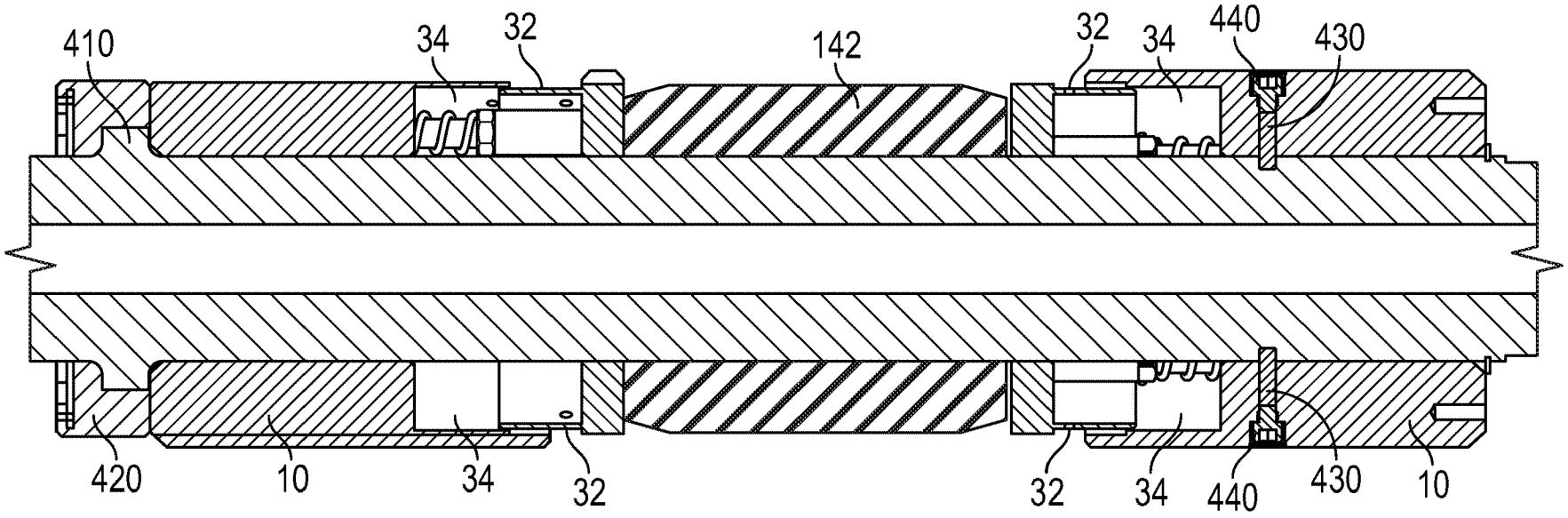
FIG. 4 is a side cross-section view of a seal element between two seal back up rings in open position.

FIG. 4 shows a cross section of a seal assembly 140 about a mandrel 400. In this view, the left portion of the seal assembly 140 is the upper, top portion, and the right portion of the seal assembly 140 is the lower, bottom portion. Seal assembly 140 comprises a retaining ring 420, an upper seal back-up ring 10, a seal element 142, a lower seal back-up ring 10, and a plurality of shear pins 430 held in place by a plurality of shear pin caps 440. Seal assembly 140 is kept from downward motion axially along mandrel 400 by means of a connection between retaining ring 420 and an upper seal back-up ring 10 about ridge 410 of mandrel 400. Seal assembly 140 is kept from being compressed by the plurality of shear pins 430. The plurality of shear pins 430 are held in place each by a shear pin cap 440. When an upward force is applied to seal assembly 140, force is applied to shear pin 430, until shear pin 430 is overcome by that upward force and shears. Then, upper seal back-up ring 10 and lower seal back-up ring 10 are capable of compressing in view of the upward force. Additionally, seal element 142 is also capable of compressing and extending perpendicular to the longitudinal axis of mandrel 400. One of the advantages of using said plurality of shear pins 430 is that, while liner top test tool 1200 (depicted in FIG. 12) is moved down a wellbore filled with heavy fluid such as drilling mud, upward pressure is placed on lower seal back-up ring 10. Without the plurality of shear pins 430, the seal back-up rings 10 and seal element 142 would compress, causing seal element 142 to expand and rub against the casing. This rubbing would cause excess wear on seal element 142. Thus, the use of the plurality of shear pins 430 avoids unnecessary wear on seal element 142.

Seal element 142 is comprised of flexible material that is selected in view of the properties of the wellbore. In one embodiment, seal element 142 is BUNA nitrile synthetic rubber. In another embodiment, seal element 142 is hydrogenated nitrile rubber (HNBR). In yet another embodiment, seal element 142 is Viton brand synthetic rubber\fluoropolymer elastomer. We speculate that BUNA is better for lower temperatures, HNBR is better for medium temperatures, and Viton is better for higher temperatures.

FIG. 4 also depicts seal back-up rings 10 in an open position, showing boss 32 not fully inserted into bore 34.

Figure 5:
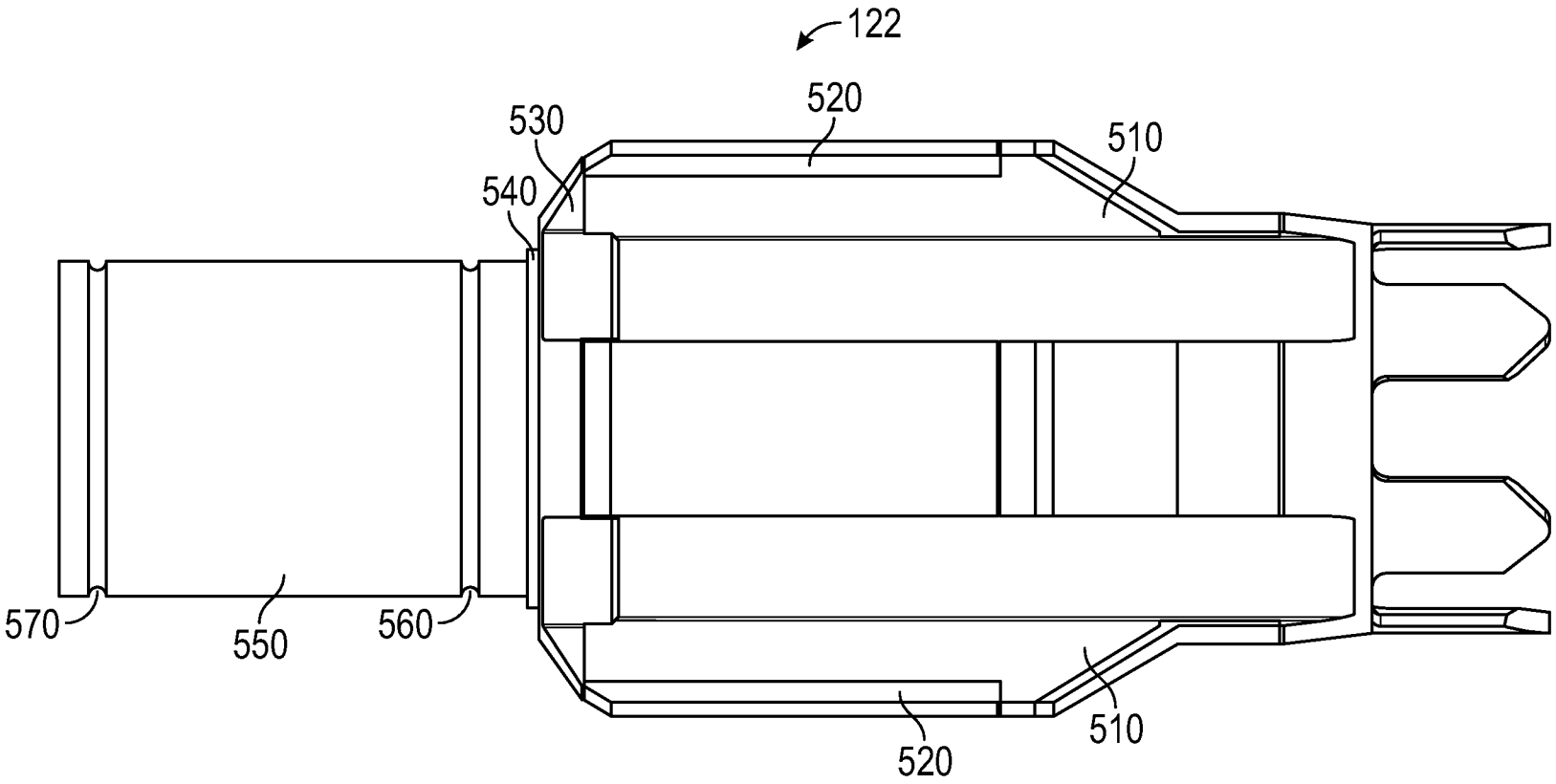
FIG. 5 is a side view of a mill shoe.

FIG. 5 is a side view of mill-shoe 122. Mill-shoe 122 may also be referred to as a mill-head. In use, mill-shoe 122 has a central hollow core 580 and fits around a mandrel 400. Mill-shoe 122 comprises a plurality of mill-shoe ridges 510, which raise outward from the central axis of mill-shoe 122, each mill-shoe ridge 510 being removably connected with one mill-shoe insert 520 and held in place by a mill-shoe insert cap 530 and a retaining ring 540. Mill-shoe 122 is capable of receiving mill-shoe ridges 510 of varying sizes, to accommodate the cleaning of casing or lower liner of varying sizes, without having to custom fabricate a mill-shoe 122 for each specific use. Mill-shoe insert cap 530 and retaining ring 540 extend around the circumference of mill-shoe 122. Mill-shoe 122 further comprises connector tube 550. Connector tube 550 further comprises first groove 560 and second groove 570. Connector tube 550 receives scraper cartridge 700 (depicted in FIG. 7), and scraper cartridge 700 is affixed to mill-shoe 122 by means of bearings 1100 (depicted in FIG. 11) locked in place, thereby affixing mill-shoe 122 to scraper cartridge 700 (restricting axial movement of scraper cartridge 700 relative to mill-shoe 122), but allowing rotation of scraper cartridge 700 about mandrel 400.

Figure 6:
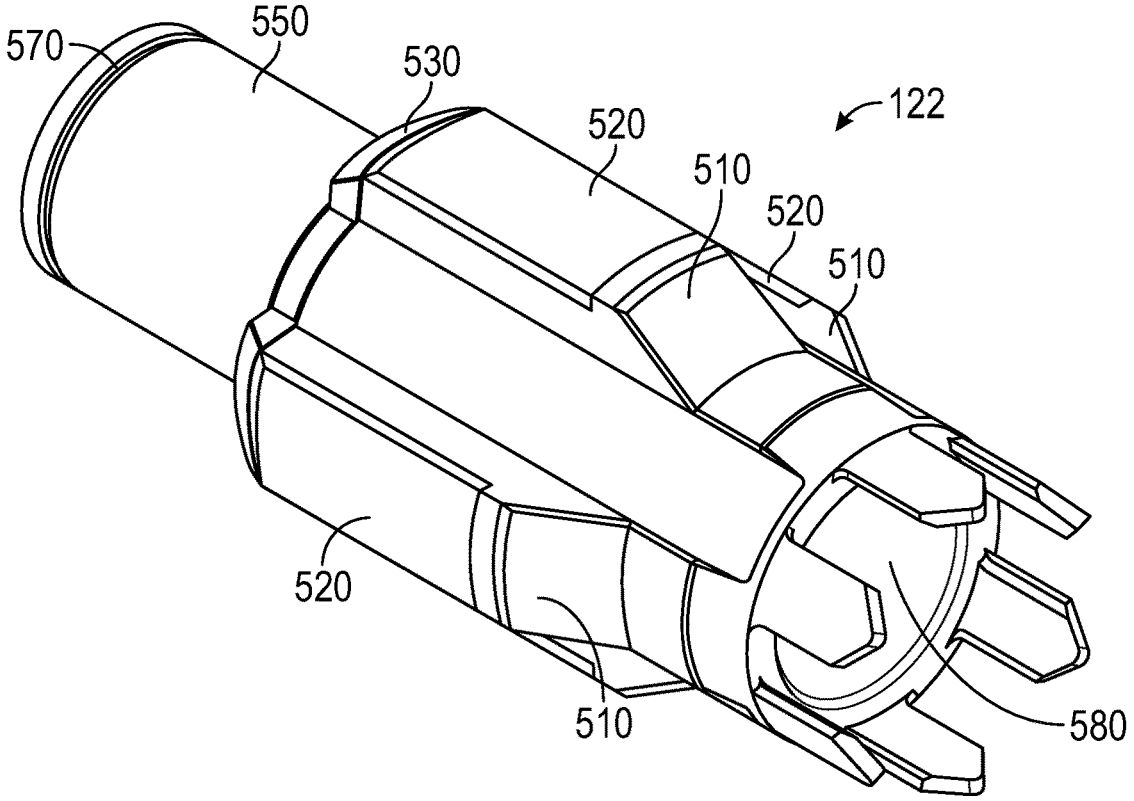
FIG. 6 is a perspective view of a mill shoe.

FIG. 6 is a perspective view of mill-shoe 122.

Figure 7:
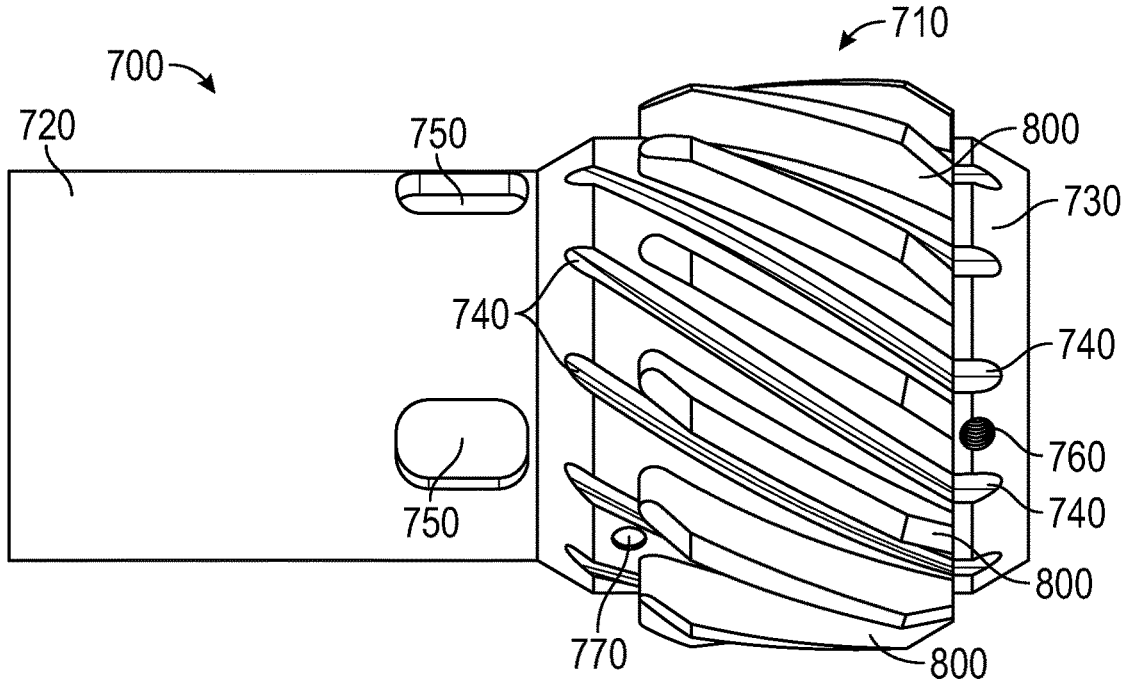
FIG. 7 is a side view of a scraper cartridge.

FIG. 7 is a side view of scraper cartridge 700. In use, scraper cartridge 700 has a central hollow core 785 and fits around a mandrel 400. Scraper cartridge 700 comprises blade mount 710, coupling end 720, and scraper end cap 730. Blade mount 710 comprises a plurality of grooves 740, a plurality of blade receptacles 745 (see FIG. 11), and a plurality of blades 800. Each blade 800 is inserted into a blade receptacle 745 of blade mount 710. Scraper end cap 730 is removably affixed to blade mount 710, holding said plurality of blades 800 secured in blade mount 710. When installed, the blades 800 overlap each other around the circumference of blade mount 710 in a corkscrew fashion (as depicted in FIG. 7). When said scraper end cap 730 is removed, one or more of said plurality of blades 800 may be removed and replaced. Coupling end 720 further comprises a plurality of holes 750 for allowing fluid to flow through coupling end 720 and past scraper cartridge 700. Fluid can also flow through and along said plurality of grooves 740. Blade mount 710 further comprises a plurality of lower threaded holes 760 and a plurality of upper threaded holes 770. Lower threaded holes 760 are threaded holes extending through blade mount 710 at a lower portion of blade mount 710 and are each capable of receiving a bearing 1100. Each of said plurality of lower threaded holes 760 are aligned about the circumference of blade mount 710 and are coplanar in a plane orthogonal to the longitudinal axis of blade mount 710 and mandrel 400. Upper threaded holes 770 are threaded holes extending through blade mount 710 at an upper portion of blade mount 710 and are each capable of receiving a bearing 1100. Each of said plurality of upper threaded holes 770 are aligned about the circumference of blade mount 710 and are coplanar in a plane orthogonal to the longitudinal axis of blade mount 710 and mandrel 400. Lower threaded holes 760 and upper threaded holes 770 are offset so as to align with first groove 560 and second groove 570, respectively, when connector tube 550 of mill-shoe 124 is inserted into central hollow core 785 of scraper cartridge 700.

Figure 8A:
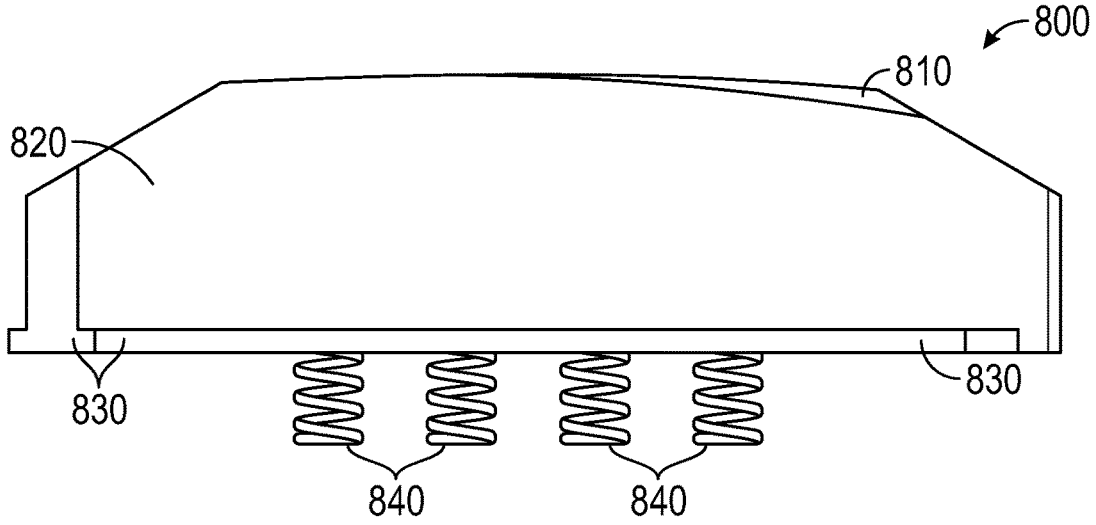
FIG. 8A is a side view of a scraper blade.
Figure 8B:
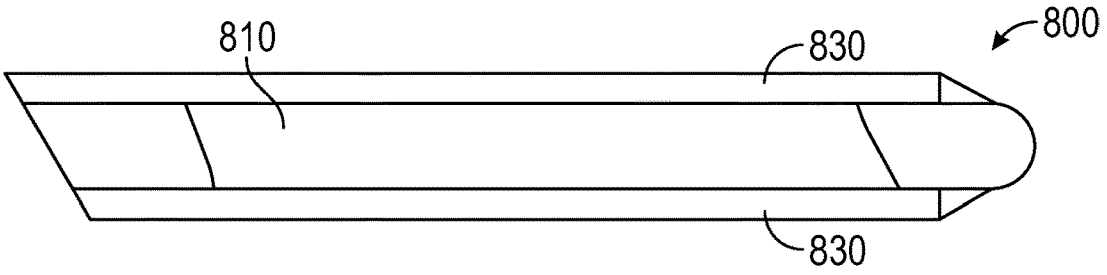
FIG. 8B is a top view of a scraper blade.
Figure 8C:
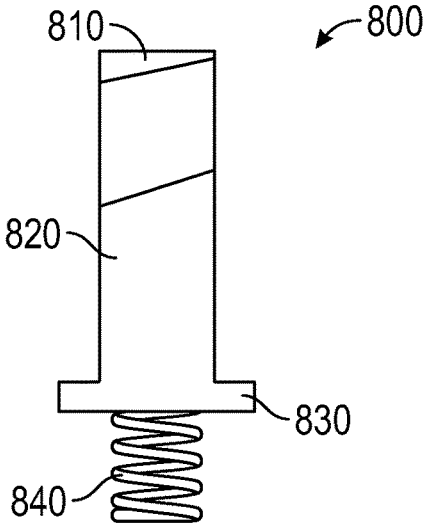
FIG. 8C is an end view of a scraper blade.

FIGS. 8A, 8B, and 8C depict a blade 800. Blade 800 comprises a scraping edge 810, raised member 820, a base 830, and a plurality of springs 840. Base 830 extends horizontally outward, perpendicular to raised member 820, and raised member 820 extends upward, away from base 830. Scraping edge 810 is an angled edge of raised member 820. Said plurality of springs 840 are springs affixed to a bottom of base 830 which, when blade 800 is inserted into blade mount 710 of scraper cartridge 700, push blade 800 outward, radially, away from a central axis of scraper cartridge 700.

Figure 9:
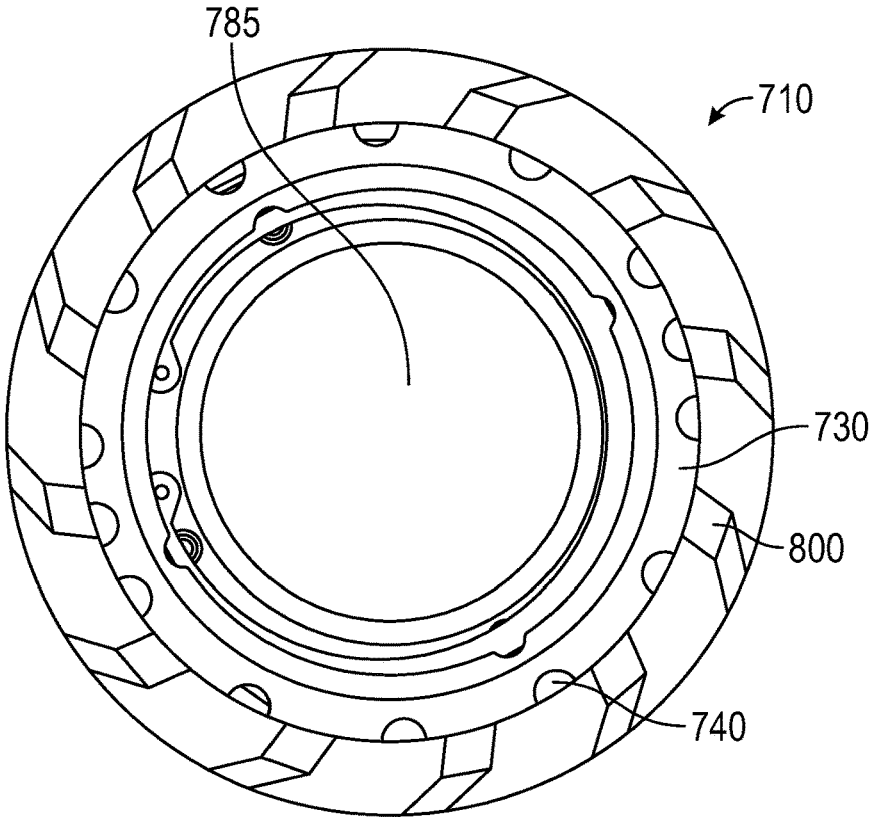
FIG. 9 is a bottom view of a scraper cartridge.

FIG. 9 is a bottom view of scraper cartridge 700, depicting scraper end cap 730 holding blade mount 710 in place.

Figure 10:
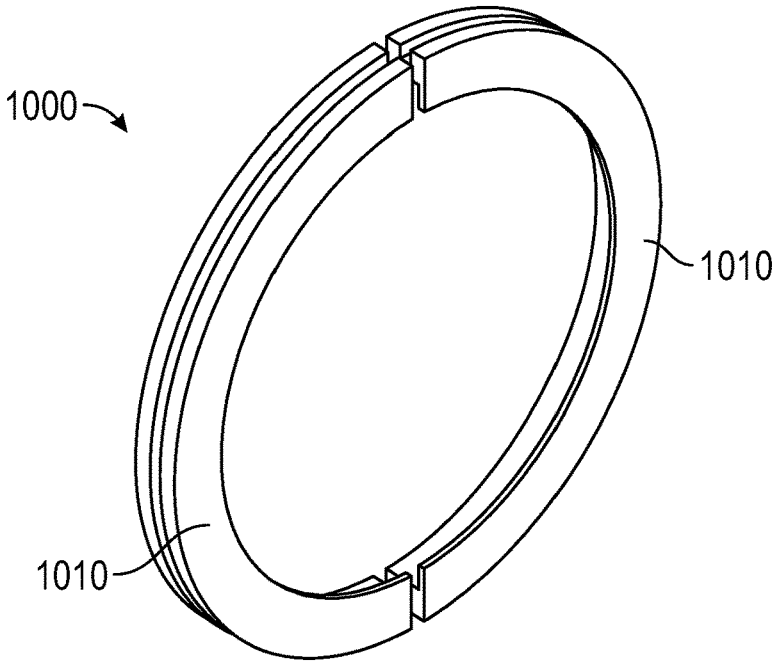
FIG. 10 is a perspective view of a shear ring.

FIG. 10 depicts a shear ring 1000. Shear ring 1000 is sized to fit into a groove about the circumference of mandrel 400 and extend outward from mandrel 400 to block axial movement of mill-shoe assembly 120 (mill-shoe assembly 120 may also be referred to as a mill-head assembly). Shear ring 1000 is designed to shear when a force greater than a predetermined force is applied by mill-shoe assembly 120 to shear ring 1000. In an exemplary embodiment, shear ring 1000 is comprised of two identical semi-circular members 1010.

Figure 11:
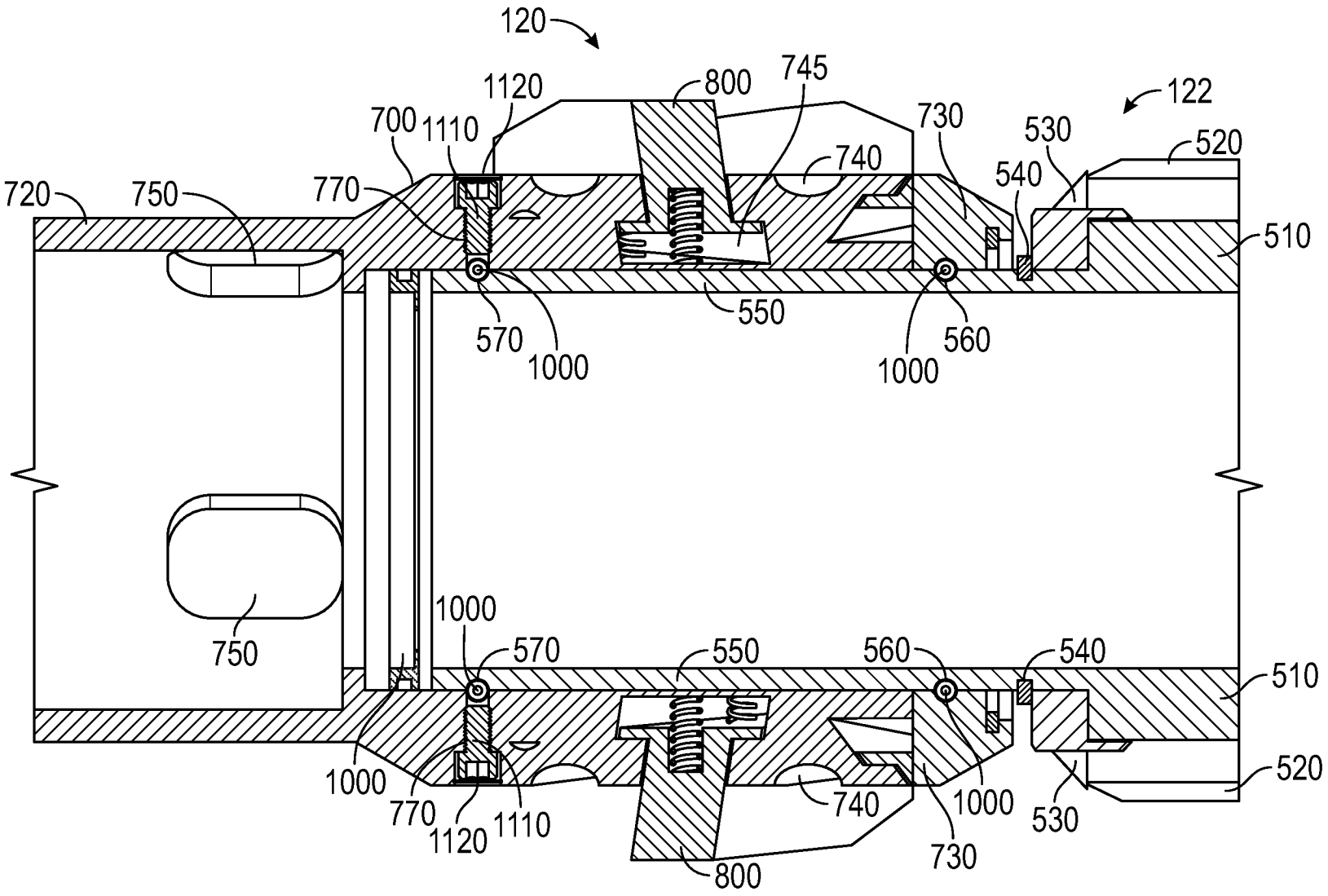
FIG. 11 is a side cross-section view of a mill shoe interlocked with a scraper cartridge.

FIG. 11 depicts mill-shoe assembly 120. Mill-shoe assembly 120 comprises mill-shoe 124 locked in place with scraper cartridge 700. A plurality of bearings 1100 is inserted into said plurality of lower threaded holes 760 and said plurality of upper threaded holes 770, such that one bearing 1100 is inserted into each of said plurality of lower threaded holes 760 and is seated in said first groove 560, and such that one bearing 1100 is inserted into each of said plurality of upper threaded holes 770 and is seated in said second groove 570. Each of said plurality of bearings 1100 is locked in place by a fastener 1110, and each fastener 1110 is sealed by a retaining ring 1120. The plurality of bearings 1100 locked in place in said first groove 560 and said second groove 570 restrict the axial movement of scraper cartridge 700 relative to mill-shoe 124, allowing scraper cartridge 700 to rotate independently relative to mill-shoe 124 and mandrel 400.

Figure 12:
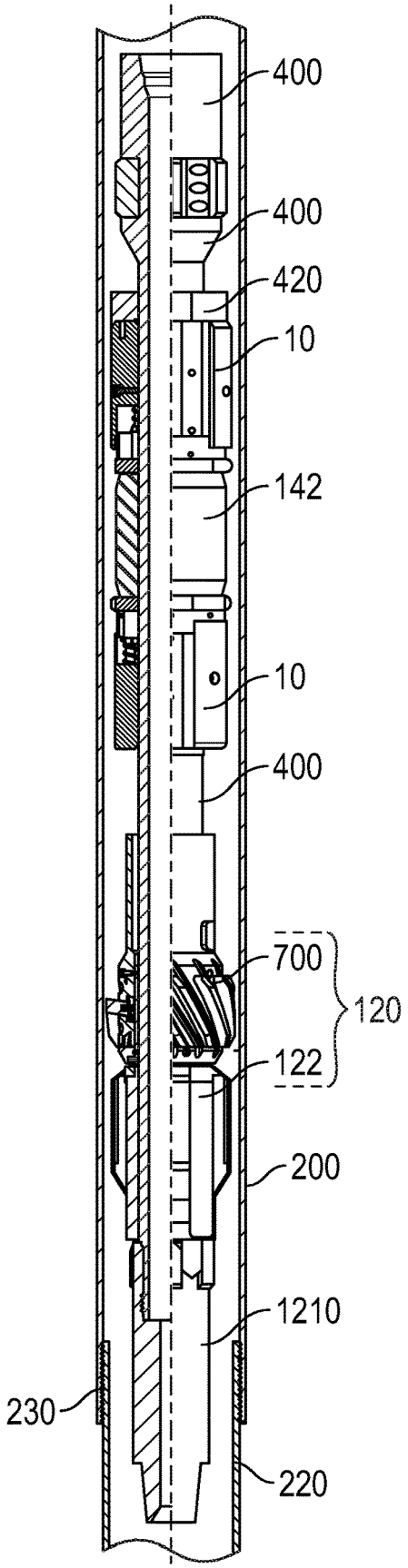
FIG. 12 is a side view of a liner top test tool in an uncompressed position in a wellbore.

FIG. 12 depicts liner top test tool 1200 inserted into casing 200 and lower liner 220. Liner top test tool 1200 comprises mandrel 400, configured with retaining ring 420, two seal back-up rings 10, seal element 142, mill-shoe assembly 120 (mill-shoe 122 and scraper cartridge 700) as detailed in the discussion of the foregoing figures. Shown now in FIG. 12 is end-sub 1210. End-sub 1210 receives the bottommost portion of mandrel 400 and interlocks with mill-shoe 122, preventing rotation of mill-shoe 122 about mandrel 400. Shear ring 1000 and the plurality of shear pins 430 are in place (but not visible in FIG. 12).

Figure 13:
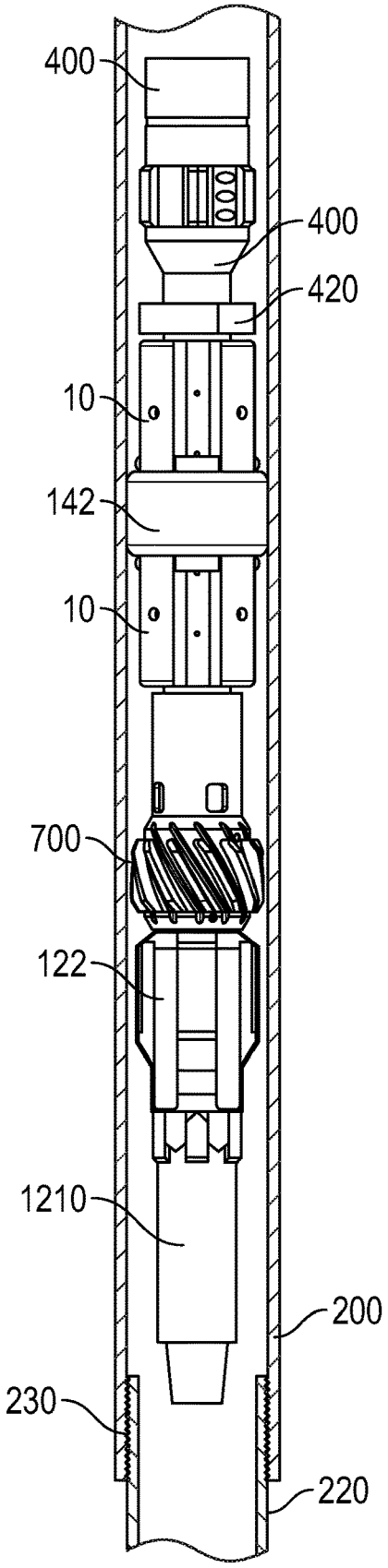
FIG. 13 is a side view of a liner top test tool in a compressed position in a wellbore.

FIG. 13 depicts liner top test tool 1200 in use, after upward force has been applied to mill-shoe 122, causing shear ring 1000 to shear, allowing mill-shoe assembly 120 to move upward axially along mandrel 400 causing coupling end 720 to push against the lower seal back-up ring 10, causing compression of the seal back-up rings 10, shearing of the plurality of shear pins 430, and compression, and bulging caused by compression, of seal element 142.

In an embodiment, blade 800, as well as all of the other parts of liner top test tool 1200, are made of 4140 stainless steel.

In use, to test the seal 230 between casing 200 and lower liner 220, the liner top test tool 1200 is incorporated onto a work-string and slowly lowered into the casing 200 of a wellbore through heavy drilling mud. A drill bit on the work-string may serve as a guide until the liner top test tool 1200 comes in contact with the top of the lower liner 220 in the wellbore.

When the liner top test tool 1200 is being lowered into the wellbore, the seal back-up rings 10 are in the open position (see FIG. 1A). In this position, the compression springs 16 of the seal back-up rings 10 are extended to move the first ring 12 away from the second ring 14 to open the flow channels 20 around the periphery of the seal back-up rings 10. When the flow channels 20 are open, the flow area between the wellbore casing 200 around the seal back-up rings 10 will be enhanced.

As the liner top test tool 1200 is lowered into place, scraper cartridge 700 presses against casing 200, scraping and cleaning the entire circumference of the interior of casing 200, removing debris. As scraper cartridge 700 scrapes against casing 200, there is the possibility that one or more of the blades 800 will become lodged into casing 200 and become stuck. If this happens, the circumferential positioning of the blades 800 in a corkscrew fashion, coupled with the downward pressure of liner top test tool 1200 in the wellbore, causes scraper cartridge 700 to rotate about the longitudinal axis of mandrel 400 and mill-shoe assembly 120, dislodging scraper cartridge 700 from casing 200.

Once the liner top test tool 1200 is placed in a desired position with respect to the top of the lower liner 220, the drill string is rotated to rotate the mill-shoe 122 to loosen any extraneous cement or debris around the top of the liner 220 as heavy mud is circulated into the work-string. The flow of heavy mud and associated loosened debris will move up and out of the casing 200 through the flow channels 20 around the seal back-up rings 10.

The work-string weight on the mill-shoe 122 is then increased to cause shearing of shear ring 1000. When shear ring 1000 is sheared, the mill-shoe assembly 120 will slide upward towards the lower seal back-up ring 10, as depicted in FIG. 13. As seal element 142 is compressed between seal back-up rings 10, seal element 142 bulges outward and the compression springs 16 of the seal back-up rings 10 compress and move the first ring 12 against the second ring 14 of each seal back-up ring 10 so that the flanges 18 will block the flow channels 20 around the periphery of the seal back-up rings 10. This forms a pressure seal between the liner top test tool 1200, top of liner 220, and casing 200.

When the liner top test tool 1200 is positioned at the top of the lower liner 220, the fluid force in the work-string and the casing 200 are still in balance. The work-string and liner top test tool 1200 may then be raised a few feet above the top of the lower liner 220 and a light fluid such as seawater is then pumped into the work-string until the heavy mud is pushed up the casing 200 to a few feet above the liner top test tool 1200. The pressure of the light fluid is then slowly bled down from the work-string to a point where it is determined that the light fluid can contain well pressure and that there is no leak at the pressure seal between the liner top test tool 1200 and the casing 200. When such condition exists, the heavy mud is no longer needed to contain the well pressure. The liner top test tool 1200 may then be pulled up to release the seal element 142, and the heavy mud may then be pumped out of the wellbore.

It will be understood that each of the elements described above, or two or more together may also find a useful application in other types of methods differing from the type described above. Without further analysis, the foregoing will so fully reveal the gist of the present disclosure that others can, by applying current knowledge, readily adapt it for various applications without omitting features that, from the standpoint of prior art, fairly constitute essential characteristics of the generic or specific aspects of this disclosure set forth in the appended claims. The foregoing embodiments are presented by way of example only; the scope of the present disclosure is to be limited only by the following claims.

What is claimed is:

1. A seal back-up ring for use in a liner top test tool for testing a seal provided between a sealing element and an adjacent wellbore casing, said seal back-up ring comprising:

a first ring, said first ring comprising a radially extending flange and a tubular boss, said tubular boss having a plurality of holes operable to allow fluid flow;

a second ring, said second ring comprising a channel on a peripheral surface of said second ring, a bore operable to slidably receive said tubular boss of said first ring, and an alignment guide;

a compression spring configured to bias said first ring away from said second ring along a longitudinal axis of said second ring; and an assembly bolt attached to said first ring, said assembly bolt further comprising an alignment pin;

wherein said alignment guide is configured to receive said alignment pin, and wherein said radially extending flange of said first ring aligns with said channel of said second ring when said alignment pin is received by said alignment guide.

2. The seal back-up ring of claim 1, wherein said alignment guide further comprises a restrictor plate, said restrictor plate having an opening, wherein said restrictor plate divides said alignment guide into an inner guide and an outer guide, wherein said inner guide is located on a side of said restrictor plate closer to said first ring and said outer guide is located on a side of said restrictor plate farther from said first ring, and wherein said alignment pin extends through said opening.

3. The seal back-up ring of claim 2, wherein said alignment pin further comprises a radially extending restrictor member located on an end of said alignment pin located within said outer guide, wherein said radially extending restrictor member is larger than said opening such that said alignment pin is prevented from completely exiting said outer guide.

4. The seal back-up ring of claim 3, wherein said compression spring comprises a first end and a second end, wherein said first end pushes against said restrictor plate, said second end pushes against said assembly bolt, and said compression spring is coiled around said alignment guide.

5. The seal back-up ring of claim 3, wherein said radially extending restrictor member comprises a restrictor nut.

6. The seal back-up ring of claim 1, wherein said radially extending flange of said first ring is moved against said channel of said second ring, thereby blocking said channel and reducing an available flow path between said seal back-up ring and said casing when said liner top test tool is placed in said casing.

7. A seal back-up ring for use in a liner top test tool for testing a seal provided between a sealing element and an adjacent wellbore casing, said seal back-up ring comprising:

a first ring, said first ring comprising a plurality of radially extending flanges and a tubular boss, said tubular boss having a plurality of holes operable to allow fluid flow;

a second ring, said second ring comprising a plurality of channels on a peripheral surface of said second ring, a bore operable to slidably receive said tubular boss of said first ring, and a plurality of alignment guides;

a plurality of compression springs configured to bias said first ring away from said second ring along a longitudinal axis of said second ring; and a plurality of assembly bolts attached to said first ring, each said assembly bolt of said plurality of assembly bolts further comprising an alignment pin;

wherein each alignment guide of said plurality of alignment guides is configured to receive an alignment pin of an assembly bolt of said plurality of assembly bolts, and wherein each radially extending flange of said plurality of radially extending flanges aligns with a channel of said plurality of channels when said plurality of alignment pins are received by said plurality of alignment guides.

8. The seal back-up ring of claim 7, wherein each said alignment guide of said plurality of alignment guides further comprises a restrictor plate, and each said restrictor plate comprising an opening;

wherein each respective restrictor plate divides its respective alignment guide into an inner guide and an outer guide; and wherein each alignment pin of each assembly bolt of said plurality of assembly bolts extends through an opening of a restrictor plate of an alignment guide of said plurality of alignment guides.

9. The seal back-up ring of claim 8, wherein each alignment pin of each assembly bolt of said plurality of assembly bolts further comprises a radially extending restrictor member; and wherein each respective radially extending restrictor member of each respective alignment pin is larger than the opening of the restrictor plate through which said respective alignment pin extends.

10. The seal back-up ring of claim 9, wherein each compression spring of said plurality of compression springs comprises a first end and a second end, wherein the first end of each compression spring of said plurality of compression springs pushes against a restrictor plate of an alignment guide of said plurality of alignment guides, the second end of each compression spring of said plurality of compression springs pushes against an assembly bolt of said plurality of assembly bolts, and each compression spring of said plurality of compression springs is coiled around an alignment guide of said plurality of alignment guides.

11. The seal back-up ring of claim 9, wherein each said radially extending restrictor member comprises a restrictor nut.

12. The seal back-up ring of claim 7, wherein said plurality of radially extending flanges of said first ring is moved against said plurality of channels of said second ring, thereby blocking said plurality of channels and reducing an available flow path between said seal back-up ring and said casing when said liner top test tool is placed in said casing.

13. A liner top test tool for testing the integrity of casing in a wellbore comprising:

a seal back-up ring, wherein said seal back-up ring comprises: a first ring, said first ring comprising a plurality of radially extending flanges, and a tubular boss having a plurality of holes operable to allow fluid flow; a second ring, said second ring comprising a plurality of fluid flow channels radially spaced around a peripheral surface of said second ring, each said fluid flow channel corresponding to one of said plurality of radially extending flanges of said first ring, a bore capable of slidably receiving said tubular boss, and an alignment guide; and an alignment pin attached to said first ring; wherein said alignment guide is operable to receive said alignment pin.

14. The liner top test tool of claim 13, further comprising: a mandrel, an end-sub, and a mill-shoe assembly, wherein said end-sub is attached to a bottom end of said mandrel and said mill-shoe assembly is slidably connected to said end-sub on said mandrel; and wherein said mill-shoe assembly comprises a mill-shoe rotationally engaged with a scraper cartridge.

15. The liner top test tool of claim 14, wherein said scraper cartridge comprises a plurality of removable blades aligned in a corkscrew fashion on said scraper cartridge.

16. The liner top test tool of claim 15, wherein each removable blade of said plurality of removable blades further comprises a plurality of springs; wherein each of said plurality of springs pushes each respective one of said plurality of blades radially outwards towards said casing when said plurality of removable blades are engaged with said scraper cartridge.

17. The liner top test tool of claim 16, wherein said plurality of blades are operable to clean an inner surface circumference of said casing without rotation of said liner top test tool.

18. The liner top test tool of claim 17, wherein said scraper cartridge further comprises a plurality of grooves, wherein each grove of said plurality of grooves is located between two of said plurality of removable blades.

19. The liner top test tool of claim 18 further comprising: a compressible seal element, wherein is configured such that upward pressure in said wellbore causes upward movement of said mill-shoe assembly relative to said mandrel, and said upward movement of said mill-shoe assembly pushes said seal back-up ring against said compressible seal element.

20. The liner top test tool of claim 19, further comprising a second seal back-up ring, wherein said seal back-up ring is positioned above said compressible seal element and said second seal back-up ring is positioned below said compressible seal element, and said second seal back-up ring is fixed in place on said mandrel by a shear pin, wherein said shear pin is capable of resisting shear forces caused by said liner top test tool being lowered into a wellbore.

21. The liner top test tool of claim 20, wherein said mill-shoe further comprises a plurality of removable mill-shoe inserts capable of removing debris from a lower liner in said wellbore when said mill-shoe is rotated.

* * * * *